US005664510A

United States Patent [19]

Kitamura

[11] Patent Number: 5,664,510

[45] Date of Patent: Sep. 9, 1997

[54] BLINDSTITCH MACHINE

[75] Inventor: Hideo Kitamura, Toyonaka, Japan

[73] Assignee: Yamato Mishin Seizo Kabushiki Kaisha, Osaka, Japan

[21] Appl. No.: 201,047

[22] Filed: Feb. 24, 1994

Related U.S. Application Data

[63] Continuation of Ser. No. 988,201, Dec. 9, 1992.

[30] Foreign Application Priority Data

Feb. 14, 1992 [JP] Japan ..... 4-5922 U

[51] Int. Cl.[6] ..... D05B 1/24

[52] U.S. Cl. ..... 112/178; 112/304; 112/314; 112/320

[58] Field of Search ..... 112/176, 177, 112/178, 304, 311, 312, 313, 314, 320

[56] References Cited

U.S. PATENT DOCUMENTS

| | | | |
|---|---|---|---|
| 4,114,547 | 9/1978 | Russell | 112/178 |
| 4,311,106 | 1/1982 | Hanneman | 112/304 X |
| 5,136,956 | 8/1992 | Kitamura | 112/178 |
| 5,152,237 | 10/1992 | Block et al. | 112/304 |
| 5,182,999 | 2/1993 | Dietl | 112/178 |

FOREIGN PATENT DOCUMENTS

| | | |
|---|---|---|
| 4111050A1 | 10/1991 | Germany . |
| 3128067 | 12/1991 | Japan . |

*Primary Examiner*—Paul C. Lewis
*Attorney, Agent, or Firm*—Darby & Darby

[57] ABSTRACT

A blindstitch machine provided with a mechanism for feeding an end of the fabric to a position where a needle of the machine main body passes thereby to form the seam from the start end of the fabric, wherein the rotating amount of a belt is adjusted corresponding to the feeding amount of a feed dog of the machine main body, for instance, adjusted to synchronize the fabric feeding by the machine main body with that by the belt, so that the fabric is sewed without being wrinkled or stretched about the passing position of the needle.

1 Claim, 9 Drawing Sheets

BLINDSTITCH MACHINE

This is a continuation of application Ser. No. 7/988,201, filed Dec. 9, 1992.

BACKGROUND OF THE INVENTION

1. Field of the Invention

This invention relates to a blindstitch machine wherein a mechanism for feeding an end of a fabric to the sewing position of a main body of the machine is provided in front of the main body so as to form a seam from the end of the fabric where to start the sewing.

2. Description of the Related Art

A blindstitch machine is a sewing machine to blindstitch a folded edge of a fabric such as a hem of clothes. In this kind of blindstitch machine, a sickle-like sewing needle in front of a feed dog, while traveling with a circular motion in a direction perpendicular to the feeding direction of the fabric, stitches by scooping a half of the thickness of the main fabric and the folded hem of the fabric. Since sewing can start only after an end Fe of the fabric 1 is fed under the feed dog provided at the back of the sewing position, no seam is formed for a distance A from the end Fe of the fabric 1 fed under the feed dog to a position where the sewing needle passes first as shown for FIG. 1(*a*). Therefore, a part of the fabric left without a seams is necessary to be hand-stitched after the sewing.

In order to eliminate the above inconvenience inherent in the conventional blindstitching, the applicants of this invention have proposed an improved blindstitch machine (Japanese Utility Model Application No. 2-37494, 1990, U.S. Pat. No. 5,136,956 granted Aug. 11, 1992, based on application Ser. No. 675,974 filed Mar. 28, 1991), wherein a feeding mechanism by the rotation of a belt in touch with the lower surface of the fabric is provided in front of the feed dog, to feed the fabric towards the passing position of the needle.

With this machine it is possible to start sewing while the end Fe of the fabric 1 is set ahead of the passing position of the needle, so that, as indicated in FIG. 1(*b*), the seam S is formed from the start end Fe of the fabric 1. The feeding amount of the fabric by the main body is adjusted by a driving mechanism of the feed dog of the main body, thereby securing a suitable feeding amount corresponding to the kind of the fabric and the seam length. However, the feeding timing may not synchronize between the main body and the feeding mechanism because of the fixed rotating amount of the belt of the feeding mechanism. In such case, the fabric 1 may be undesirably wrinkled or stretched in front of and in the rear of the sewing position.

SUMMARY OF THE INVENTION

This invention has been devised to solve the aforementioned problems and has for its main object to provide a blindstitch machine equipped with a fabric feeding mechanism capable of adjusting the rotating amount of a feeding belt when feeding a start end of a fabric to the sewing position of a machine main body to, for example, synchronize the fabric feeding of the feeding mechanism with that of the main body so as to form a seam from the start end of the fabric without the fabric being wrinkled or stretched in front of and in the rear of the sewing position.

The above and further objects and features of the invention will more fully be apparent from the following detailed description with accompanying drawings.

DESCRIPTION OF THE PREFERRED EMBODIMENT

Now, this invention will be discussed in detail in conjunction with one preferred embodiment thereof with reference to the accompanying drawings.

Figure 1A:
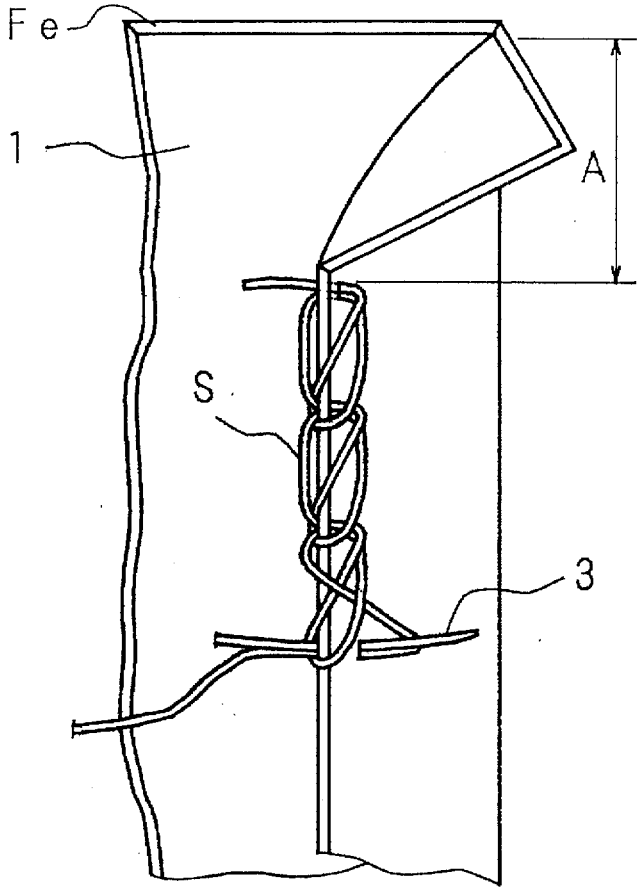
FIG. 1(*a*) and 1(*b*) are diagrams of seams at the sewing starting position in a conventional blindstitch machine without a fabric feeding mechanism in front of a machine main body and in a conventional blindstitch machine with a fabric feeding mechanism, respectively.
Figure 1B:
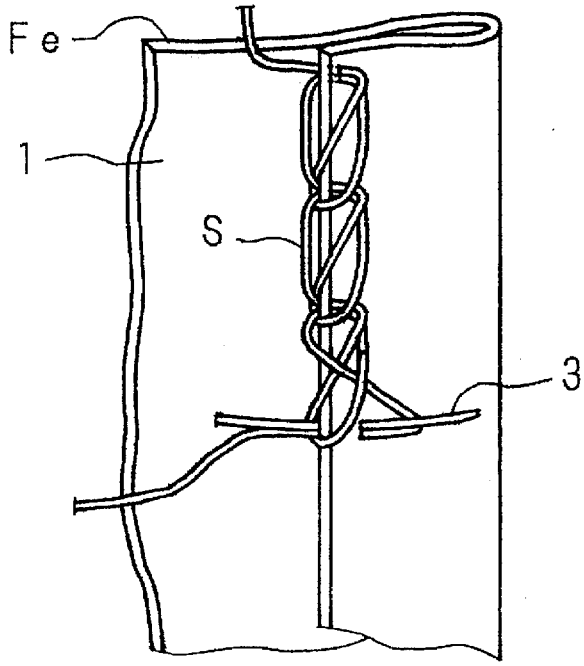
Figure 2:
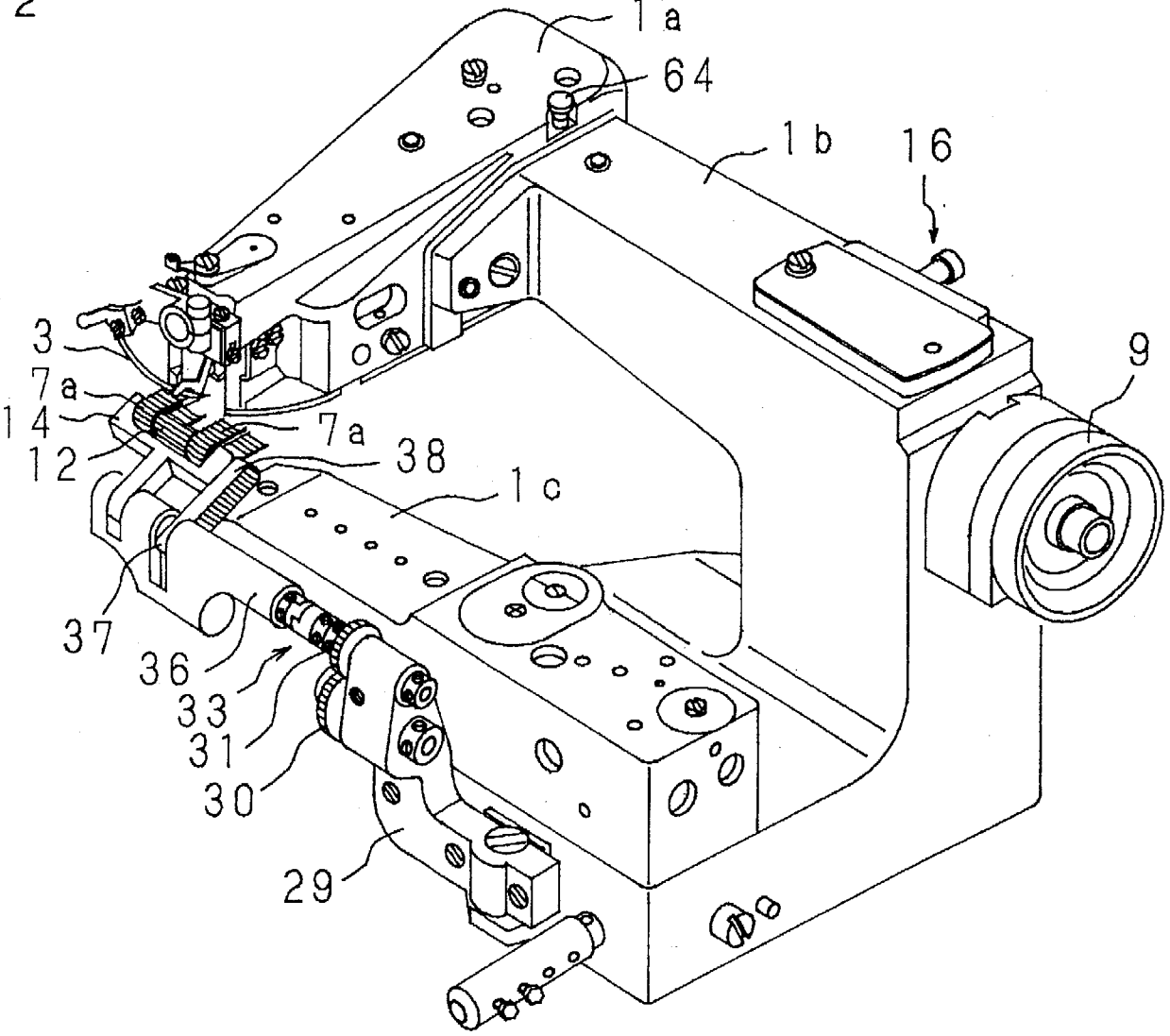
FIG. 2 is a perspective view of a blindstitch machine according to this invention.
Figure 3:
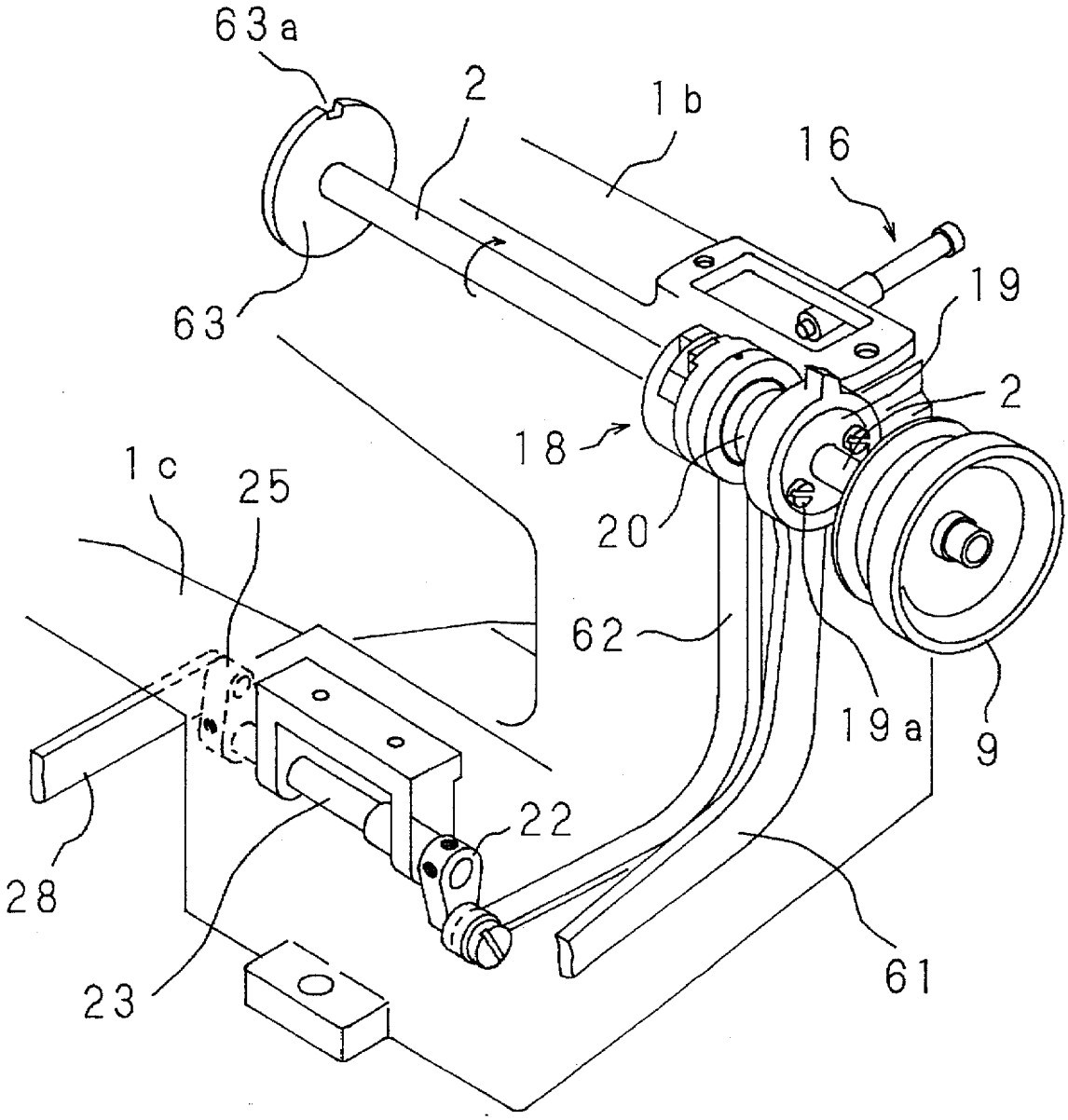
FIG. 3 is a partial perspective view indicating the internal structure of the blindstitch machine according to this invention.

FIG. 2 is a front perspective view of a blindstitch machine of this invention, and FIG. 3 is a partial front perspective view showing the internal structure of the machine. In these drawings, 1*a* is a head in which a driving system of a needle 3, a driving system of a feed dog 5, etc. are contained, 1*b* is an arm incorporating a main shaft 2 which transmits the driving force of a motor (not shown) received by a pulley 9 to the driving system, etc., and 1*c* represents a bed provided with a driving system of a pair of belts 7*a*, 7*a*, and the like.

Figure 4:
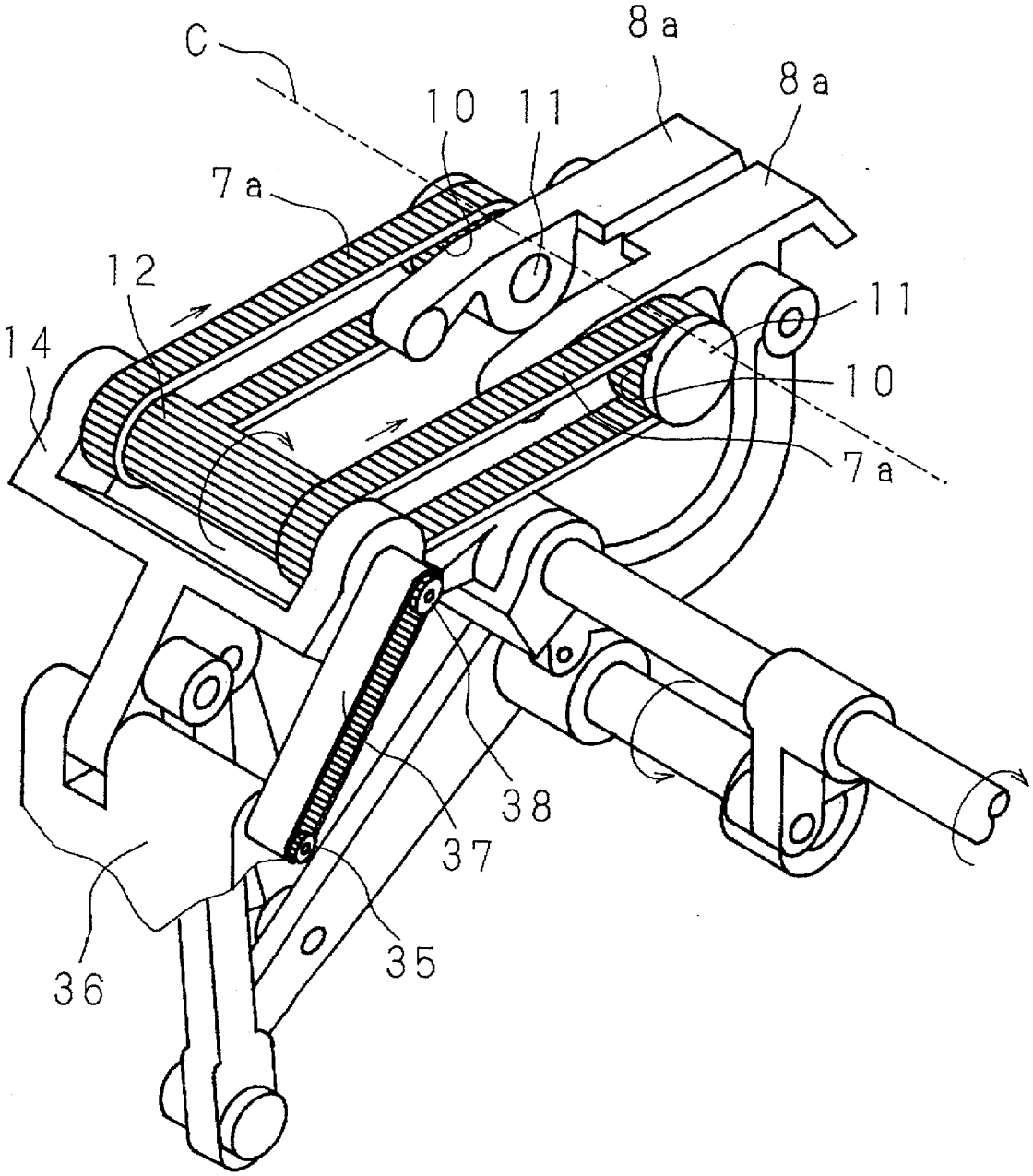
FIG. 4 is a perspective view of the vicinity of belts of a fabric feeding mechanism 0f the blindstitch machine according to this invention.
Figure 5:
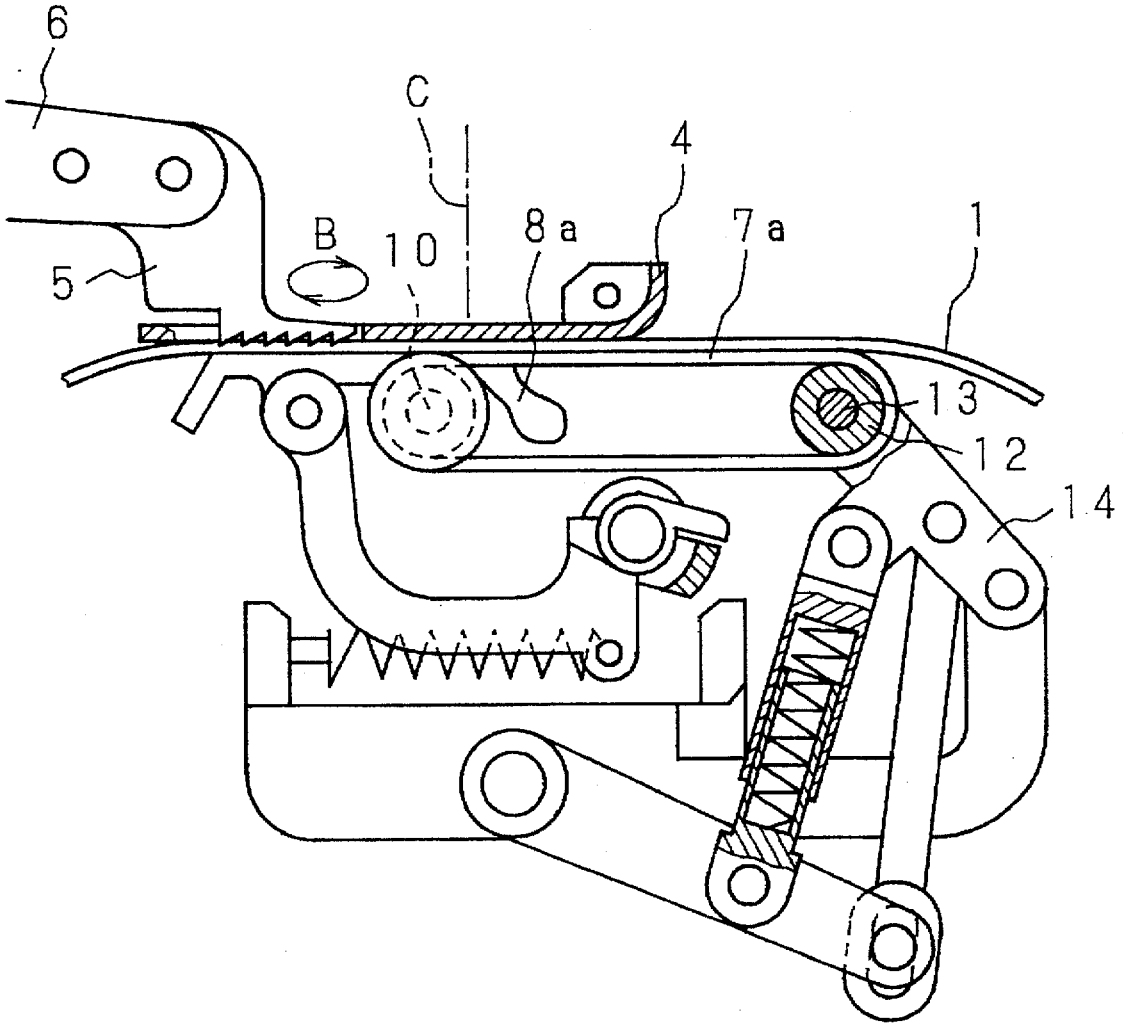
FIG. 5 is a left side view of the vicinity of the belt.

FIG. 4 is a perspective view and FIG. 5 is a left side view of the vicinity of the belts 7*a*, 7*a*.

A two section-divided presser foot 8*a*, 8*a* is mounted swingably in the rear of a passing course C of the needle 3 to press the fabric from the lower surface. A pair of supports 4, 4 are formed above the front end of the presser foot 8*a*, 8*a*. The fabric is held between the supports 4, 4 and the presser foot 8*a*, 8*a*. Above the rear end of the presser foot 8*a*, 8*a*, the feed dog 5 is provided confronting to the presser foots 8*a*, 8*a*. The feed dog 5 is driven by a feed bar 6 of the main body to perform an elliptical motion as shown in FIG. 5. In the lower half of the elliptical locus B, the feed dog 5 travels backward thereby to send the fabric 1 backward held between the presser foot 8*a*, 8*a* and the supports 4, 4.

A pair of toothed belts 7*a*, 7*a* are arranged beneath the fabric passing area and in front of the passing course C of the needle 3, interposing the presser foot 8*a*, 8*a* therebetween. The rear ends of the belts 7*a*, 7*a* are wound around belt pulleys 10, 10 which are axially fitted in the holes at the front ends of the presser foot 8*a*, 8*a* and extend in a direction perpendicular to the fabric feeding direction. On the other hand, the front ends of the belts 7*a*, 7*a* are wound around one toothed belt pulley 12 having a rotary shaft 13 parallel to the shafts 11, 11 of the belt pulleys 10, 10.

Both ends of the belt pulley 12 are supported by a U-shaped bracket 14 which is coupled to the presser foot 8*a*, 8*a* by a link mechanism, therefore, the bracket 14 moves up and down in association with the vertical motion of the presser foot 8*a*, 8*a*. An end of the shaft 13 of the belt pulley 12 projects from the bracket 14, and a pulley 38 is provided at the projecting end. A toothed belt 37 is wound around both the pulley 38 and a pulley 35 provided in the final stage of a driving force transmission system which will be described later, thereby to transmit the driving force. Consequently, the upper belts 7*a*, 7*a* travel backward.

As is clear from FIG. 3, on the main shaft 2 built in the arm 1*b* is mounted a known feed lift eccentric 20 to lift up the fabric closer to the pulley 9 which transmits the driving force from the motor (not shown). A ring formed at the upper end of a rod 61 is outfitted with the feed lift eccentric 20 on the side of the pulley 9. A lid 19 is tightened by a screw 19a in order to prevent the rod 61 from slipping. On the left side in FIG. 3 of the feed lift eccentric 20 is provided a feeding amount adjusting section 18 for intermittent driving and adjustment of the rotating amount of the belts 7*a*, 7*a*.

Figure 6:
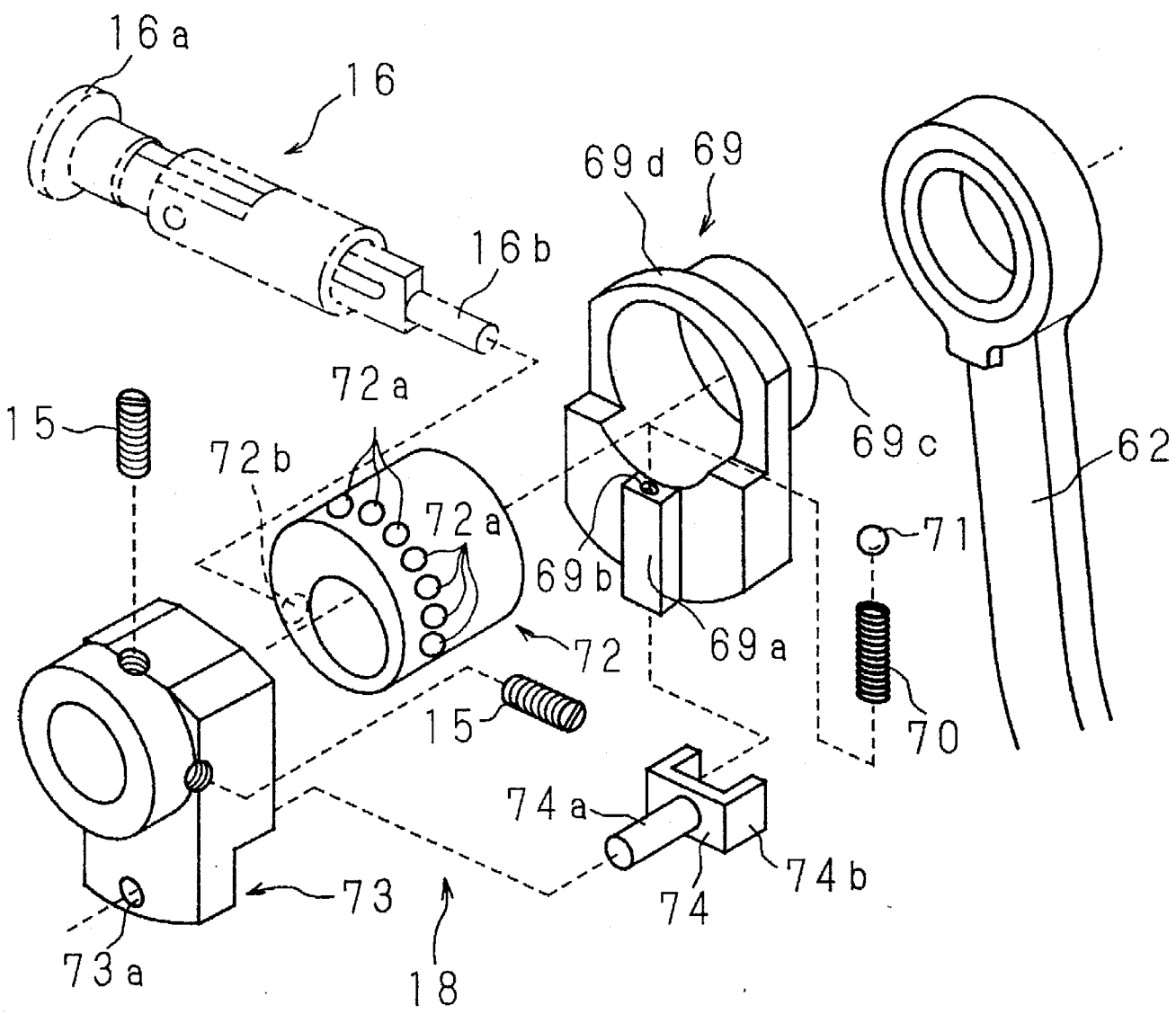
FIG. 6 is a disassembled perspective view of a feeding amount adjusting section of the fabric feeding mechanism of the blindstitch machine according to this invention.
Figure 7:
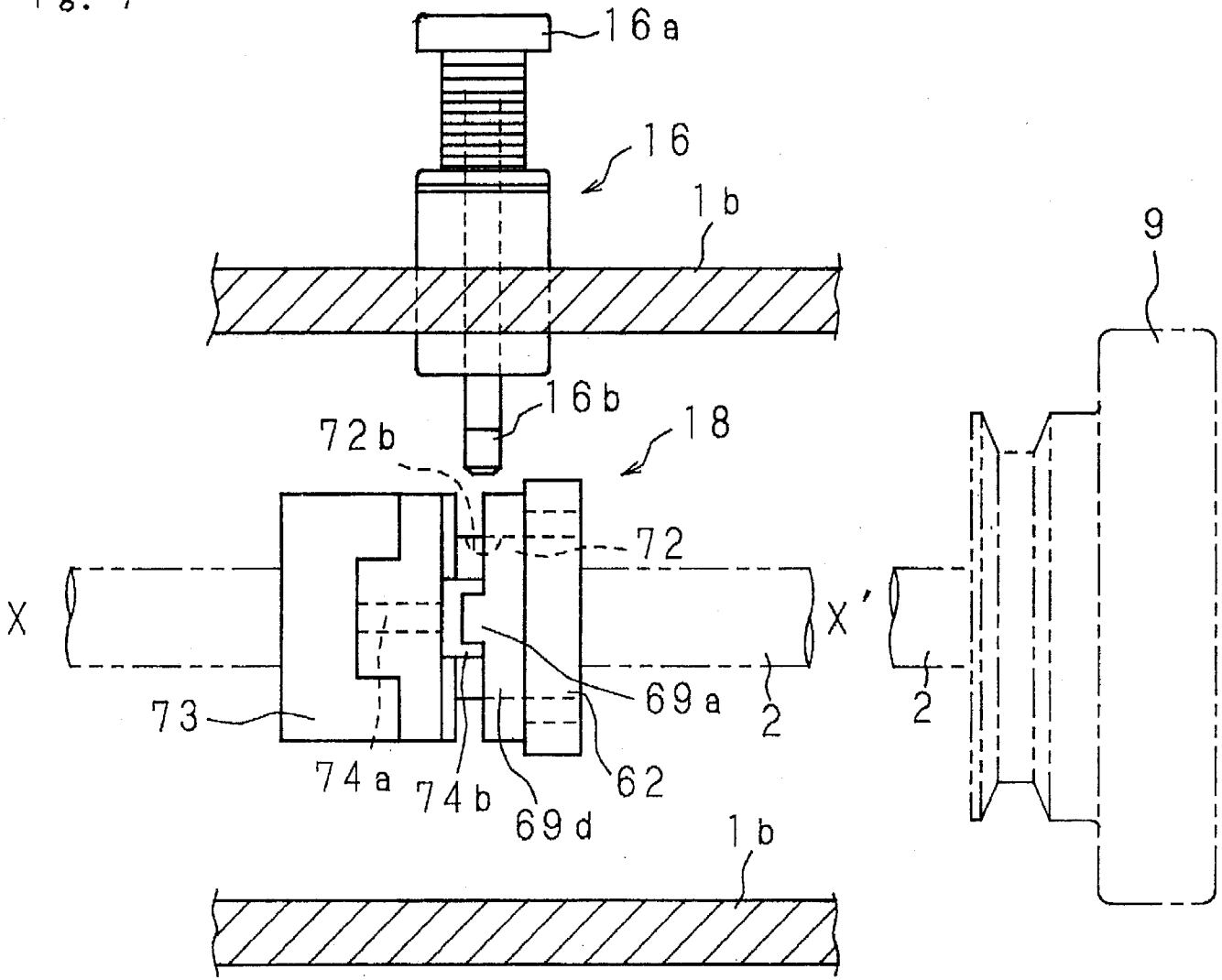
FIG. 7 is a lateral cross sectional view of the feeding amount adjusting section.
Figure 8:
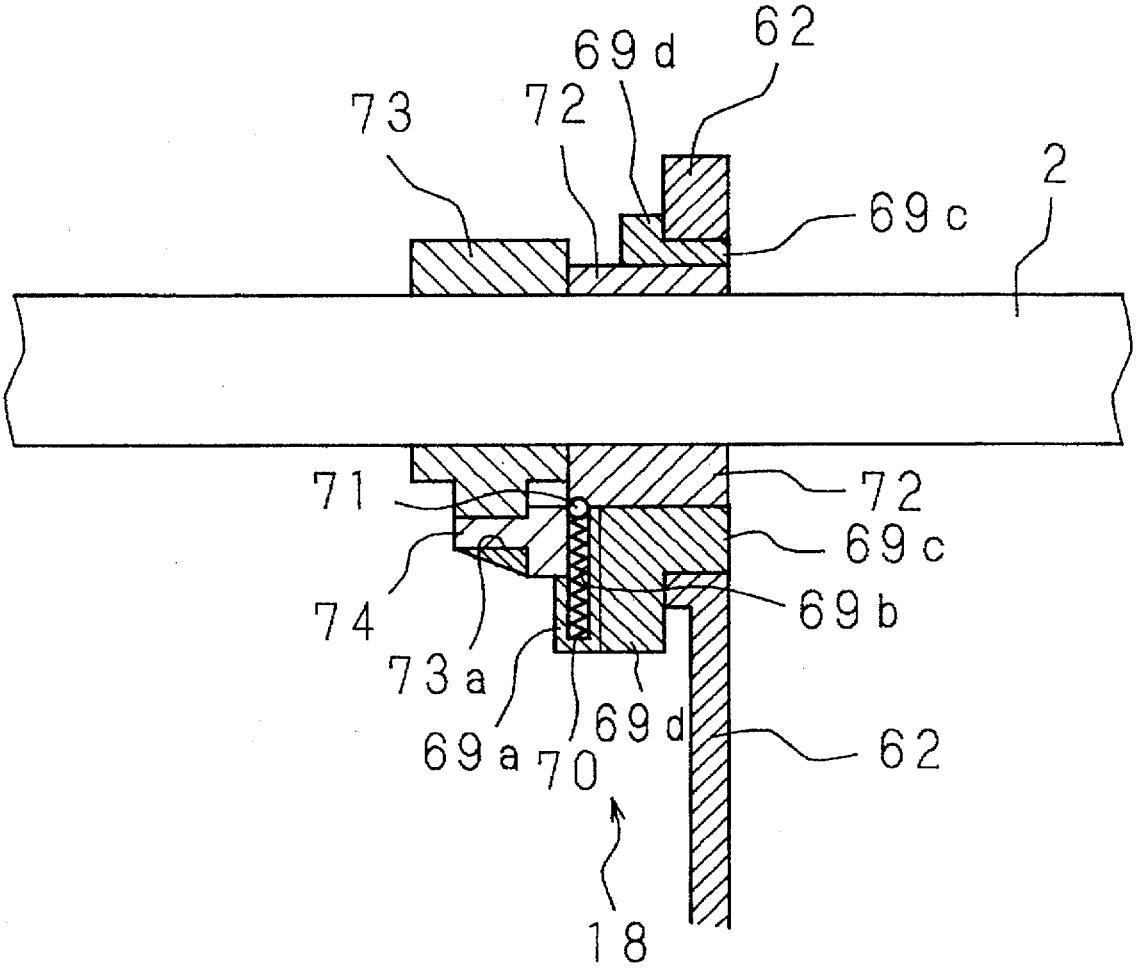
FIG. 8 is a longitudinal cross sectional view of the feeding amount adjusting section.

The feeding amount adjusting section 18 is clearly illustrated in a disassembled perspective view, a lateral cross sectional view and a longitudinal cross sectional view of FIGS. 6 through 8, respectively. The phase in FIG. 7 is different from that of FIGS. 6 and 8. An eccentric cylindrical bushing 72 is rotatably fitted around the main shaft 2, and whose outer surface is eccentric to the main shaft 2 as indicated in FIG. 6. A plurality of holes 72*a*, 72*a*, . . . $^{20}$ are formed on the outer peripheral surface of the bushing 72 in positions with eccentricities proportional to the respective feeding amounts of the feed dog 5 of the main body thereby to determine the rotating amount of the belts 7*a*, 7*a*, i.e., the feeding amount of the fabric toward the main body. Moreover, a hole 72*b* is formed at an axially different position from the holes 72*a* in the peripheral direction of the bushing 72. The positions of the holes 72*a*, 72*a*, . . . $^{\circ}$ are determined relatively to the structure of a feeding amount adjusting system of the feed dog 5 of the main body.

On the left side of the eccentric bushing 72 in FIG. 6, an eccentric pin mounting bed 73 is outfitted around the main shaft 2 and fixed thereto by screws 15, 15. The lower portion of the mounting bed 73 projects downward, where a pin hole 73*a* penetrates in a direction parallel to the main shaft 2. A circular cylindrical pin 74*a* of an eccentric pin 74 is inserted into the pin hole 73*a*. A U-shaped fitting portion 74*b* open to the main shaft 2 at the end of the pin 74*a* is outfitted with a guide 69*a* of a feed adjusting unit 69 to be described later.

The right side face of the mounting bed 73 touches the left side face of the eccentric bushing 72. The feed adjusting unit 69 referred to hereinbefore is fixed to the eccentric bushing 72 rotatably on the right side of the mounting bed 73. The feed adjusting unit 69 has an eccentric cylindrical portion 69*c* and a flange-like stopper 69*d* at the left end of the opening of the eccentric cylindrical portion 69*c*. The inner diameter of the eccentric cylindrical portion 69*c* is set slightly larger than the outer diameter of the eccentric bushing 72. A rectangular guide 69*a* projecting leftward is formed at the lower end of the stopper 69*d*, which is slidably fitted into the fitting portion 74*b* of the eccentric pin 74. The guide 69*a* has a hole 69*b* which opens upward at the upper end of the guide 69*a*. The fitting portion 74*b* of the eccentric pin 74 is guided by the guide 69*a* of the feed adjusting unit 69 to slide in a centripetal or centrifugal motion in accordance with the eccentricity of the adjusting unit 69.

A coil spring 70 and a ball 71 are inserted into the hole 69*b* of the guide 69*a*. A half of the ball 71 pushed by the coil spring 70 in a projecting direction from the hole 69*b* by the coil spring 70 into any of the holes 72*a*, 72*a*, . . . $^{20}$ of the eccentric bushing 72, whereby the relative position between the outer peripheral surface of the eccentric bushing 72 and the feed adjusting unit 69 is fixed. By this fixing of the relative position, the eccentricity of the rotational axis of the feed adjusting unit 69 from the main shaft 2 is determined. In other words, the feeding amount varies owing to a combination of the eccentric cylindrical portion 69*c* and the eccentricity of the eccentric bushing 72. At the upper end of a j-shaped rod 62 is formed a ring which is rotatably fitted around the cylindrical portion 69*c* of the feed adjusting unit 69.

A locking member 16 is penetrating the back of the arm 1*b*. When handling a button 16a of the locking member 16 outside the arm 1*b*, the tip of a button shaft 16*b* inside the arm 1*b* is inserted into the hole 72*b* of the eccentric bushing 72, thus restricting the rotation of the eccentric bushing 72, or the the tip of the button shaft 16*b* is pulled out from the hole 72*b*, thus allowing the rotation of the eccentric bushing 72.

Figure 9:
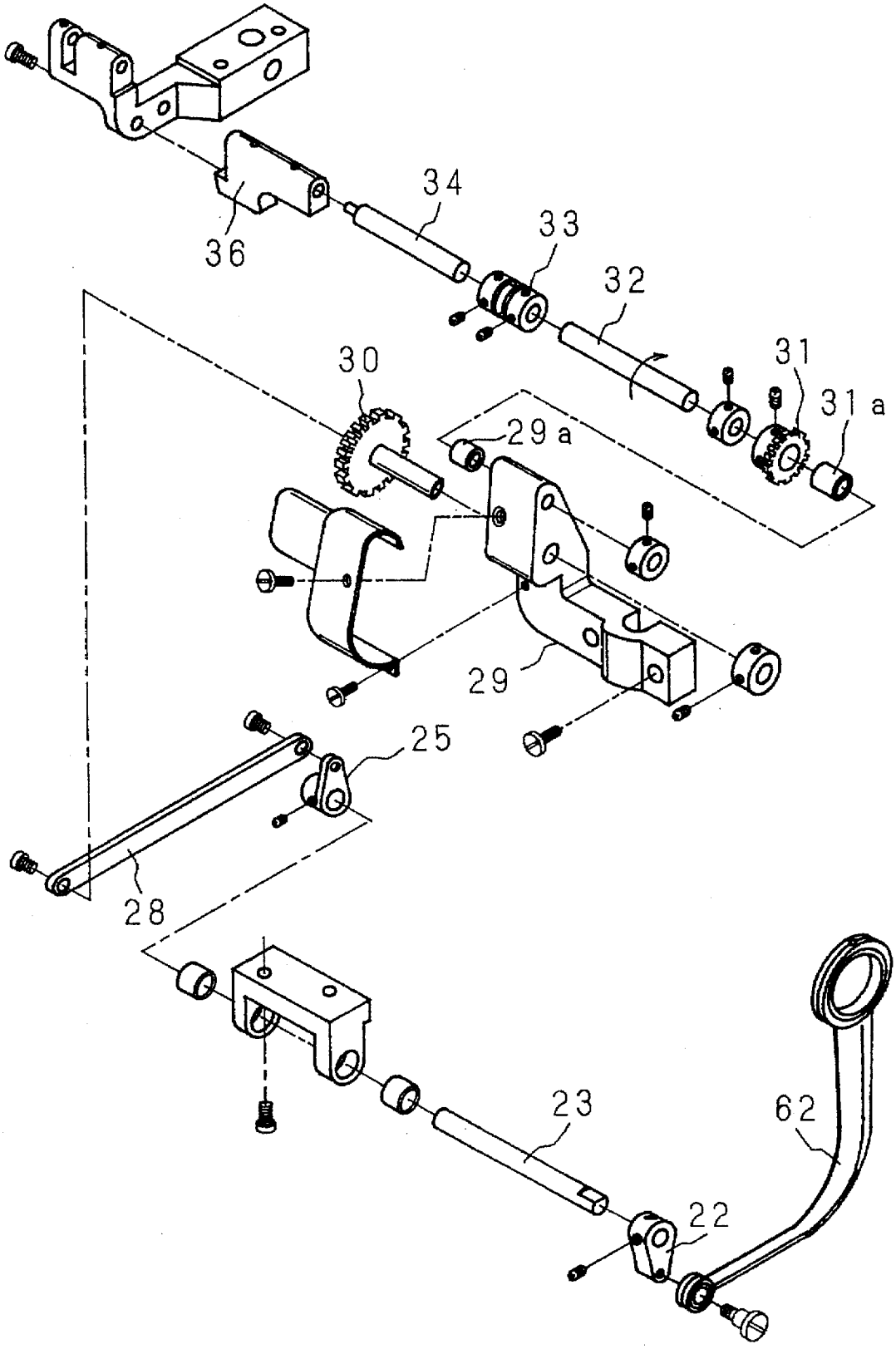
FIG. 9 is a disassembled perspective view of a driving force transmission system to the belts of the blindstitch machine according to this invention.

As will be described later, the leading end of the j rod 62 swings in accordance with the eccentric rotation of the upper end thereof. As shown in FIGS. 3 and 9, a small ring at the leading end of the rod 62 is rotatably coupled to one end of a handle 22. The other end of the handle 22 is mounted to the right end of a transmission shaft 23 rotatably installed in a horizontal direction within the bed 1*c*. One end of a similar handle 25 is mounted to the left end of the transmission shaft 23, and the leading end of a coupling arm 28 is rotatably coupled to the other end of the handle 25. The leading end of the coupling arm 28 accordingly swings in response to the swing of the leading end of the rod 62.

FIG. 9 is a disassembled perspective view of a driving force transmission mechanism from the rod 62 to the coupling arm 28 and further to the belts 7*a*, 7*a* in the succeeding stage.

Referring to FIG. 2, a bearing block 29 fixed to the front face of the bed. 1*c* rotatably supports a shaft of a gear 30 in the horizontal direction. Moreover, as indicated in FIG. 9, to the left end face of the gear 30 the leading end of the coupling arm 28 is coupled swingably. The gear 30 meshes with a small gear 31 whose shaft is rotatably supported in the horizontal direction by the bearing block 29, similarly. The small gear 31 is fixed around a rotary shaft 32 via a one-way clutch 31*a*. The bearing block 29 has also a one-way clutch 29*a* fitted therein so as to rotate the rotary shaft 32 in one direction as indicated by an arrow in FIG. 9.

In the above-described structure, the rotary shaft 32 which is intermittently rotated in the arrow direction by the rotation of the gear 30 and the small gear 31 is intermittently driven to rotate in synchronization with the elliptical motion (namely, intermittent movement) of the feed dog 5. The rotary shaft 32 is coupled to a shaft 34 via joints 33 and the shaft 34 is rotatably fitted into a bearing block 38 installed on the left side of the bearing block 29. The pulley 35 of FIG. 4 is mounted to a part of the shaft 34 being exposed from the bearing block 38, and the toothed belt 37 is wound around the pulley 35 and the pulley 38 provided at the right end of the shaft 13, thereby transmitting the intermittent driving force of the rotary shaft 32 to the belts 7*a*, 7*a*.

Meanwhile, a disc-like feed adjusting unit 63 is provided at the main shaft 2 near the boundary between the arm 1*b* and the head 1*a* in order to adjust the feeding amount of the feed dog 5 (with reference to FIG. 3). Into a notch 63*a* formed on the periphery of the feed adjusting unit 63, a locking member 64 projecting one end outside the arm 1*b* is able to be inserted. When the locking member 64 is inserted into the notch 63*a*, the main shaft 2 is restricted from rotating (referring to FIG. 2). Since such technique as above is well known, the detailed description is omitted herein.

The feeding operation of the fabric in the blindstitch machine of this invention will be depicted hereinafter. In the first place, the feeding amount of the feed dog 5 of the main body, that is, the seam length is adjusted corresponding to the thickness, kind, etc. of the fabric. The seam length is adjusted by rotating the pulley 9 after restricting the rotation thereof to insert the locking member 64 into the notch 63*a* of the feed adjusting unit 63, and by matching a matchmark on the pulley 9 with a scale representing the desired seam length. The above operation is completely the same as in the conventional sewing machine of this kind.

Subsequently, in order to adjust the feeding amount of the feeding mechanism, the button 16*a* of the locking member 16 is handled to rotate the pulley 9, then the button shaft 16*b* is inserted into the hole 72*b* of the eccentric bushing 72, thus prohibiting the rotation of the eccentric bushing 72. Thereafter, the pulley 9 is rotated until the matchmark of the pulley 9 matches the scale of the same seam length. As a result, the ball 71 goes into the hole 72*a* of the eccentric bushing 72 corresponding to the feeding amount of the feed dog 5, so that the relative position between the outer peripheral surface of the eccentric bushing 72 and the feed adjusting unit 69 is fixed. Then, the locking member 16 is pulled out from the hole 72*b*.

Accordingly, as the pulley 9 is rotated by the motor (not shown), the needle 3 and the feed dog 5 act in the same manner as the conventional blindstitch machine.

At this time, the eccentric pin mounting bed 73 is rotated in accordance with the rotation of the main shaft 2, and therefore, the feed adjusting unit 69 is rotated via the eccentric pin 74 fixed to the mounting bed 73. While the feed adjusting unit 69 rotates the eccentric bushing 72 with the ball 71, since the outer peripheral surface of the eccentric bushing 72 is eccentric, the feed adjusting unit 69 fitted around the eccentric bushing 72 is rotated eccentrically to the main shaft 2.

In accordance with the eccentric rotation of the feed adjusting unit 69, the upper end of the rod 62 fitted around the feed adjusting unit 69 rotate eccentrically as well, thereby swinging the leading end of the rod 62. The swinging is transmitted to the coupling arm 28 via the handle 22, transmission shaft 23 and handle 25, to rotate the gear 30. The rotation of the gear 30 is transmitted to the belt pulley 12 via the small gear 31, the rotary shaft 32 rotating in one way and the toothed belt 37, which invites the intermittent rotation of the belts 7*a*, 7*a*. The rotating amount of the belts 7*a*, 7*a* is determined by the position of the hole 72*a* of the eccentric bushing 72 into which the ball 71 is inserted, and which synchronize with the feed of the feed dog 5.

It is possible, however, to adjust the rotation of the belts 7*a*, 7*a* not to synchronize with the feed of the feed dog 5 depending on the sewing condition or the kind of the fabric.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An auxiliary mechanism for a blind stitch type sewing machine having a reciprocating needle at a sewing position and a main body with a feed dog for moving the fabric to be sewn under the sewing machine needle at the sewing position, said feed dog spaced from the needle in the direction of movement of the fabric said mechanism comprising:

a rotatable belt on which the lower face of the fabric rests for feeding the fabric by an amount to the machine sewing position, and means for adjusting the feeding amount of the fabric by said belt, an eccentric member fixed to a main shaft which determines the feeding amount of said feed dog of the main body by its rotating speed, said eccentric member having a plurality of holes at different peripheral positions on the outer surface thereof, the location of the position of said holes relative to said main shaft corresponding to respective feeding amounts by said feed dog;

a feeding amount adjusting unit coupled to one of said holes of said eccentric member to be rotated eccentrically by said main shaft in accordance with the eccentricity of said one hole;

a rod coupled to said feeding amount adjusting unit which swings in one direction by an amount proportional to the eccentric rotation of said feeding amount adjusting unit; and means for transmitting the one-way motion of said rod to said belt to drive it in a direction to feed the fabric to the machine sewing position.

* * * * *